US007205267B2

(12) United States Patent
Reinhardt et al.

(10) Patent No.: US 7,205,267 B2
(45) Date of Patent: Apr. 17, 2007

(54) USE OF TRANSITION METAL COMPLEXES AS BLEACH CATALYSTS IN LAUNDRY DETERGENTS AND CLEANING COMPOSITIONS

(75) Inventors: Gerd Reinhardt, Kelkheim (DE); Ekaterina Jonas, Bad Soden (DE)

(73) Assignee: Clariant Produkte (Deutschland) GmbH, Sulzbach (DE)

( * ) Notice: Subject to any disclaimer, the term of this patent is extended or adjusted under 35 U.S.C. 154(b) by 15 days.

(21) Appl. No.: 11/041,468

(22) Filed: Jan. 24, 2005

(65) Prior Publication Data

US 2005/0209120 A1 Sep. 22, 2005

(30) Foreign Application Priority Data

Jan. 24, 2004 (DE) ..... 10 2004 003 710

(51) Int. Cl.

| | |
|---|---|
| ***C11D 3/26*** | (2006.01) |
| ***C11D 3/28*** | (2006.01) |
| ***C11D 3/39*** | (2006.01) |
| ***C11D 3/395*** | (2006.01) |

(52) U.S. Cl. ..... 510/311; 510/376; 510/499; 510/500; 8/111

(58) Field of Classification Search ..... None
See application file for complete search history.

(56) References Cited

U.S. PATENT DOCUMENTS

| | | | |
|---|---|---|---|
| 4,728,455 | A | 3/1988 | Rerek |
| 4,810,410 | A | 3/1989 | Diakun |
| 5,114,606 | A | 5/1992 | van Vliet |
| 5,114,611 | A | 5/1992 | Van Kralingen |
| 5,114,688 | A | 5/1992 | Martell |
| 5,194,416 | A | 3/1993 | Jureller |
| 5,244,594 | A | 9/1993 | Favre et al. |
| 5,246,621 | A | 9/1993 | Favre et al. |
| 5,880,281 | A | 3/1999 | Argese |
| 6,242,409 | B1 | 6/2001 | Appel |
| 6,340,661 | B1 | 1/2002 | Van Deurzen et al. |
| 6,642,195 | B2 | 11/2003 | Hage |
| 2003/0017941 | A1 | 1/2003 | Busch et al. |
| 2005/0032661 | A1 | 2/2005 | Kunz et al. |

FOREIGN PATENT DOCUMENTS

| | | |
|---|---|---|
| DE | 4416438 A1 | 11/1995 |
| DE | 4 443 177 | 6/1996 |
| EP | 0 306 089 | 3/1989 |
| WO | WO 97/07191 | 6/1998 |

OTHER PUBLICATIONS

English Abstract of DE 4416438 A1, published Nov. 16, 1995.

Hazenkamp MF et al., "Oxidation Catalysts for Dye Transfer Inhibition", Tenside, Surfactants, Detergents, vol. 36, No. 6, (Nov. 1999) pp. 393-398 Hanser, Munchen, Germany.

English Abstract of WO 97/07191, published Jun. 10, 1998.

English Abstract of DE 4 443 177, published Jun. 13, 1996.

Bucher et al., "Synthesis, X-ray Structure, Electrochemical, and EPR Studies of a Pentacoordinated Mn(II) Tetramethylcyclam Complex", Inorg. Chem, 2001, 40, pp. 5722-5726.

Guilard et al., One-pot synthesis, physicochemical characterization and crystal structures of cis- and trans- (1,4,8,11-tetraazacyclotetradecane)-dichloroiron(III) complexe, I. Chem Soc., Dalton Trans., 1997, pp. 3459-3463.

Kotek et al., "Crystal Structures and Reactivity of 3a, 5a, 8a, 10a-Tetraazaperhydropyrene Derivatives.."Collect. Czech. Chem. Commun., 2000, vol. 65, Czech Republic.

Rohde et al., "Crystallographic and Spectroscopic Characterization of a Nonheme Fe(IV)=O Complex", Science, Feb. 14, 2003, vol. 299, pp. 1037-1039.

Tripier et al., "From New Tricyclic Bisaminal Derivatives to trans-N,N'-disubstituted cyclams", Royal Soc. of Chem., Chem. Commun, 2001, pp. 2728-2729, United Kingdom.

*Primary Examiner*—Gregory R. Del Cotto
(74) *Attorney, Agent, or Firm*—Richard P. Silverman

(57) ABSTRACT

The use is claimed of transition metal complexes of the formula (I)

$$[M(L)Y_n]X_m \quad (I)$$

where
M is a metal atom from the group of Mn and Fe,
L is a ligand of the general formula (II) or (III)

(II)

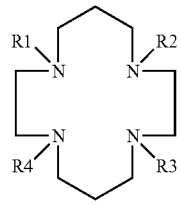

(III)

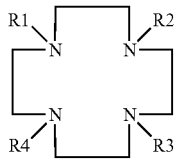

where R1, R2, R3 and R4 are the same or different and are each H, $C_1$–$C_8$-alkyl or $C_6$–$C_{12}$-alkaryl; X and Y are each an uncharged or anionic ligand from the group of $CH_3CN$, chloride, bromide, nitrate, perchlorate, sulfate, citrate, hexafluorophosphate, trifluoromethanesulfonate, tetrafluoroborate, tetraphenylborate or an anion of organic acids having $C_1$–$C_{22}$ carbon atoms, n and m are each a number from 0 to 4 as bleach catalysts in laundry detergents and cleaning compositions.

3 Claims, No Drawings

USE OF TRANSITION METAL COMPLEXES AS BLEACH CATALYSTS IN LAUNDRY DETERGENTS AND CLEANING COMPOSITIONS

The present invention relates to the use of certain macrocyclic, N-containing ligands, in particular unbridged cyclen or cyclam ligands, and transition metal complexes thereof in the bleaching of colored stains both on textiles and on hard surfaces, and also to laundry detergents and cleaning compositions which comprise, such complexes.

Inorganic peroxygen compounds, especially hydrogen peroxide and solid peroxygen compounds, which dissolve in water with release of hydrogen peroxide, such as sodium perborate and sodium carbonate perhydrate, have been used for some time as oxidants for disinfection and bleaching purposes. The oxidative action of these substances in dilute solutions depends greatly on the temperature; for example, sufficiently rapid bleaching of soiled textiles is achieved only at temperatures above about 80° C. with $H_2O_2$ or perborate in alkaline bleach liquors.

At lower temperatures, the oxidative action of the inorganic peroxygen compounds may be improved by adding what are known as bleach activators. For this purpose, numerous proposals have been developed in the past, in particular from the substance classes of the N- or O-acyl compounds, for example polyacylated alkylenediamines, in particular tetraacetylglycoluril, N-acrylated caprolactams such as benzoylcaprolactam, acetylcaprolactam or nonanoylcaprolactam, hydantoins, hydrazides, triazoles, hydrotriazines, urazoles, diketopiperazines, sulfurylamides and cyanurates, and also carboxylic anhydrides, in particular phthalic anhydride and substituted maleic anhydrides, carboxylic esters, in particular sodium nonanoyloxybenzenesulfonate (NOBS), sodium isononanoyloxybenzenesulfonate (ISONOBS) and acylated sugar derivatives such as pentaacetylglucose. Addition of these substances allows the bleaching action of aqueous peroxide solutions to be boosted to such an extent that substantially the same actions occur at temperatures around 60° C. as with the peroxide solution alone at 95° C.

In the pursuit of energy-saving washing and bleaching processes, application temperatures distinctly below 60° C., in particular below 45° C., down to cold water temperature have gained significance in the last few years.

At these low temperatures, the action of activator compounds known hitherto generally decreases perceptibly. There has therefore been no shortage of efforts to develop more active bleaching systems for this temperature range, without there having been a convincing success to date.

One starting point therefor arises from the use of transition metal salts and complexes thereof, as described, for example, in EP 0 237 111, EP 0 272 030, EP 0 306 089, EP 0 392 592 or EP 0 443 651. In addition, WO 97/07191 proposes complexes of manganese, iron, cobalt, ruthenium and of molybdenum with ligands of the salen type as catalysts for peroxygen compounds in cleaning solutions for hard surfaces.

A multitude of complexes having macrocyclic N-containing ligands has been described as bleach catalysts in the literature in the last few years. For instance, EP 0 439 387 claims binuclear metal complexes with ligands, obtained by reacting a dialdehyde with primary polyamines, as oxygen carriers.

EP 0 458 397 and '398 describe the use of manganese complexes of the general form $[L_nMn_mX_p]^zY_q$ where L includes macrocyclic, N-containing ligands. The ligands described are in particular based on 1,4,7-trimethyl-1,4,7-triazacyclononane ($Me_3TACN$) and derivatives thereof. Compounds of the $[LMn(OR)_3]Y$ type are described in EP 0 544 519, useful ligands being in particular TACN, $Me_3TACN$, 1,5,9-trimethyl-1,5,9-triazacyclodecane. Transition metal complexes having rigid ligands, in particular rigidly bridged N-containing macrocycles having at least 3 donor atoms, of which 2 form a bridgehead are described comprehensively as oxidation catalysts in WO 1998/039 098. Examples of the ligands are 5,12-dimethyl-1,5,8,12-tetraazabicyclo[6.6.2]hexadecane (Bcyclam) and 5-N-octyl-12-methyl-1,5,8,12-tetraazabicyclo[6.6.2]hexadecane. WO 2001/048 298 describes corresponding bridged ligands for the bleachings with atmospheric oxygen. However, a problem in the case of these ligands is their complicated preparation which arises in particular from the introduction of the bridge into the molecule. As a result of this, the overall yields of the syntheses are not very high.

Similar metal complexes based on unbridged macrocyclic ligands are claimed in WO 2000/012 808 as "aerial bleaching systems" for use in laundry detergents and cleaning compositions. The multitude of the potential ligands listed also includes cyclam ligands and cyclen ligands of the general formulae (I) and (II):

(I)

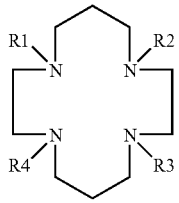

(II)

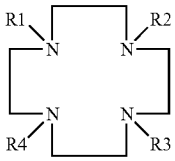

where the R1–R4 groups may be hydrogen, alkyl, aryl or heteroaryl groups, or bridging groups. No further detail is given of this compound class either in the description or in the examples.

According to the remarks made there, these compounds are explicitly only used in those laundry detergents and cleaning compositions which are free of hydrogen peroxide and other peroxy compounds.

It has now been found that, surprisingly, certain compounds within the groups of the cyclams and cyclens (I) and (II) may also be used in laundry detergents and cleaning compositions comprising hydrogen peroxide and other peroxy compounds, and have distinct advantages with regard to the bleaching capability. It is the aim of the present invention to improve the oxidative and bleaching action of laundry detergents and cleaning compositions at low temperatures below 80° C., in particular in the temperature range from approximately 20° C. to 45° C.

The invention provides the use of transition metal complexes of the formula (I)

$$[M(L)Y_n]X_m \quad (I)$$

where

M is a metal atom from the group of Mn and Fe,

L is a ligand of the general formula (II) or (III)

(II)

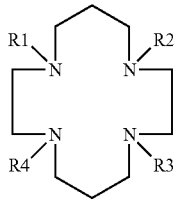

(III)

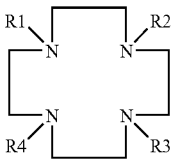

where R1, R2, R3 and R4 are the same or different and are each hydrogen, alkyl having from 1 to 8 carbon atoms or alkaryl having from 6 to 16 carbon atoms, X and Y are each an uncharged or anionic ligand from the group of $CH_3CN$, chloride, bromide, nitrate, perchlorate, sulfate, citrate, hexafluorophosphate, trifluoromethanesulfonate, tetrafluoroborate, tetraphenylborate or anions of organic acids having $C_1$–$C_{22}$ carbon atoms, n and m are each a number from 0 to 4 as bleach catalysts in laundry detergents and cleaning compositions.

Preference is giving to using complexes having central transition metal atoms in the +2, +3 or +4 oxidation states, and preference is given to complexes having manganese or iron as the central atom. The alkylaryl radicals contain from 6 to 16 carbon atoms in the alkyl moiety; phenyl is preferred as aryl.

These transition metal complexes of the formula (I) are used in laundry detergents and cleaning compositions, especially in textile washing and in cleaning compositions for hard surfaces, especially for dishes, and in solutions for bleaching colored stains. One way in which they can do this is in the presence of hydrogen peroxide, hydrogen peroxide-releasing compounds or of a peroxygen compound. Another way is that the complexes may also be activated by the oxygen of air, without the addition of a peroxo compound being necessary.

Inventive iron or manganese complexes of cyclam or tetraalkylcyclam have already been described in the literature. For instance, cis-(1,4,8,11-tetraazacyclotetradecane) dichloroiron(III) chloride and trans-(1,4,8,11-tetraazacyclotetradecane)dichloroiron(III) chloride are characterized in J. Chem. Soc. Dalton Trans., 1997, 3459–3463. Manganese derivatives of tetramethylcyclam (tmc) are described, for example, in Inorg. Chem. 2001, 40, 5722–5726. Fe(tcm)(OTf)2 is used in Science, 2003, 299, 1037–1039 as a precursor to $[FeO(tmc)(NCCH_3)](OTf)_2$. One synthesis of cyclam is described in WO 1997/049691. None of these literature references gives information on the use of these compounds as bleaches in laundry detergents and cleaning compositions.

In addition to the inventive complexes of the unsubstituted or tetra-substituted cyclams or cyclens of the formula (I), particular preference is given in particular to complexes having 2 alkyl or alkaryl radicals on the tetraazacycle having the general structures (IV) and (V):

(IV)

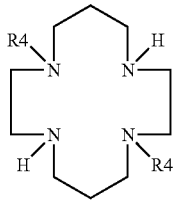

(V)

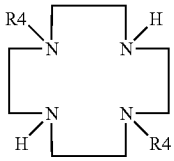

where R4 are each a methyl, ethyl, propyl, butyl or benzyl group.

Particular preference is given to complexes having the following ligands: 1,8-dimethylcyclam, 1,7-dimethylcyclen, 1,8-diethylcyclam, 1,7-diethylcyclen, 1,8-dibenzylcyclam and 1,7-dibenzylcyclen.

The ligands (IV) and (V) may be prepared according to J. Kotter et al., Collect. Czech. Chem. Commun., 2000, 65, 243–266, or R. Tripier et al., Chem. Commun., 2001, 2728–2729.

The complexes can be activated with peroxygen compounds or atmospheric oxygen. Useful peroxygen compounds are primarily hydrogen peroxide, alkali metal perborate mono- or tetrahydrates and/or alkali metal percarbonates, sodium being the preferred alkali metal. In addition, it is also possible to use alkali metal or ammonium peroxosulfates, for example potassium peroxomonosulfates (in industry: Caroat® or Oxone®). The concentration of the inorganic oxidant in the overall formulation of the laundry detergents and cleaning compositions is 2–90%, preferably 5–60%.

Useful peroxygen compounds also include oxidants on an organic basis. These include all known peroxycarboxylic acids, for example monoperoxy-phthalic acid, peracetic acid, dodecanediperoxy acid, phthalimidoperoxy-carboxylic acids such as PAP and related systems or amido peracids.

The use amounts of peroxygen compounds are generally selected such that between 10 ppm and 10% of active oxygen, preferably between 50 ppm and 5000 ppm of active oxygen, are present in the solutions of the laundry detergents and cleaning compositions. The amount of bleach-boosting complex used also depends upon the intended application. Depending upon the desired degree of activation, it is used in an amount of from 0.01 mmol to 25 mmol, preferably from 0.1 mmol to 2 mmol, of complex per mole of peroxygen compound, but it is also possible in special cases for the amount to be above or below these limits. Laundry detergents and cleaning compositions preferably contain from 0.0025 to 1% by weight, in particular from 0.01 to 0.5% by weight, of the above-defined bleach-boosting complex.

In addition to the inventive iron or manganese complexes, hydrogen peroxide and persalts, further bleach catalysts or bleach activators may be used in order to widen the efficiency spectrum of the inventive bleach systems and enhance the efficiency, especially with regard to the antimicrobial action (disinfection).

In addition to the complexes used in accordance with the invention, it is possible to use conventional bleach activators, i.e. compounds which release peroxocarboxylic acids under perhydrolysis conditions. Suitable are the customary bleach activators which contain O- and/or N-acyl groups. Preference is given to polyacylated alkylenediamines, in particular to tetraacetylethylenediamine (TAED), acylated glycolurils, in particular tetraacetylglycoluril (TAGU), acylated triazine derivatives, in particular 1,5-diacetyl-2,4-dioxohexahydro-1,3,5-triazine (DADHT), acylated phenylsulfonates, in particular nonanoyl- or isononanoyloxybenzenesulfonate (NOBS or ISONOBS) or the amido derivatives thereof, acylated polyhydric alcohols, in particular triacetin, ethylene glycol-diacetate and 2,5-diacetoxy-2,5-dihydrofuran and acetylated sorbitol and mannitol, and acylated sugar derivatives, in particular pentaacetylglucose (PAG), pentaacetylfructose, tetraacetylxylose and octaacetyllactose, and also acetylated, optionally N-alkylated, glucamine and gluconolactone. Also suitable for this use are open-chain or cyclic nitrile quats. It is also possible to use the combinations, disclosed by the German patent application DE 44 43 177, of conventional bleach activators. Benzoylcaprolactam or acetyl-caprolactam may also be used. In addition, it is also possible to use combinations of the inventive complexes with other metal complexes.

The definition of the bleaches here embraces both the bleaching of soil on the textile surface and the bleaching of soil in the wash liquor which has been detached from the textile surface. For the bleaching of stains on hard surfaces, the same applies mutatis mutandis. Further potential applications are within the personal care sector, for example in the bleaching of hair and for the improvement in the effectiveness of denture-cleaning compositions. In addition, the metal complexes described find use in commercial laundries, in wood- and paper-bleaching, the bleaching of cotton and in disinfectants.

In addition, the invention relates to a process for cleaning textiles and also hard surfaces, especially of dishes, using the complexes mentioned together with peroxygen compounds in aqueous solution optionally comprising further laundry detergent or cleaning composition constituents, and also to laundry detergents and cleaning compositions for hard surfaces, especially cleaning compositions for dishes, preference being given to those for use in machine processes, which comprise such complexes.

The inventive use consists substantially in creating conditions on hard surfaces contaminated with colored stains or on soiled textiles under which a peroxidic oxidant and the complex can react with one another, with the aim of obtaining more strongly oxidizing subsequent products. Such conditions are present especially when the reaction partners meet one another in aqueous solution. This can be done by separately adding the peroxygen compound and the complex to the aqueous solution of laundry detergent and cleaning composition. However, the process according to the invention becomes particularly advantageous with the use of a laundry detergent or cleaning composition for hard surfaces, which comprises the complex and optionally a peroxygen-containing oxidant. The peroxygen compound may also be added to the solution separately in substance or as an aqueous solution or suspension when a peroxygen-free laundry detergent or cleaning composition is used.

The laundry detergents and cleaning compositions which may be present in the form of granules, pulverulent or tableted solids, in the form of other shaped bodies, homogeneous solutions or suspensions may, apart from the bleach-boosting metal complex mentioned, in principle comprise all known ingredients which are customary in such compositions. The compositions may in particular comprise builder substances, surfactants, peroxygen compounds, additional peroxygen activators or organic peracids, water-miscible organic solvents, sequestrants, enzymes, and also special additives having color care or fiber care action. Further assistants such as electrolytes, pH regulators, silver corrosion inhibitors, foam regulators and colorants and dyes are possible.

An inventive cleaning composition for hard surfaces may additionally comprise abrasive constituents, in particular quartz meals, wood meals, polymer meals, chalks and glass microbeads, and mixtures thereof. Abrasives are present in the cleaning compositions in a content of not more than 20% by weight, in particular from 5 to 15% by weight.

The laundry detergents and cleaning compositions may comprise one or more surfactants, and useful surfactants are anionic surfactants, nonionic surfactants and mixtures thereof, but also cationic, zwitterionic and amphoteric surfactants. Such surfactants are present in the inventive laundry detergents in proportions of preferably from 1 to 50% by weight, in particular from 3 to 30% by weight, whereas cleaning compositions for hard surfaces normally contain smaller proportions, i.e. amounts of up to 20% by weight, in particular of up to 10% by weight and preferably in the range from 0.5 to 5% by weight. Cleaning compositions for use in machine dishwashing processes are normally low-foaming compounds.

Suitable anionic surfactants are in particular soaps and those which contain sulfate or sulfonate groups. Useful surfactants of the sulfonate type are preferably $C_9$–$C_{13}$-alkylbenzenesulfonates, olefinsulfonates, i.e. mixtures of alkene- and hydroxyalkanesulfonates, and also disulfonates, as are obtained, for example, from monoolefins having terminal or internal double bonds by sulfonating with gaseous sulfur trioxide and subsequent alkaline or acidic hydrolysis of the sulfonation products. Also suitable are alkanesulfonates which are obtained from $C_{12}$–$C_{18}$-alkanes, for example by sulfochlorination or sulfoxidation with subsequent hydrolysis and neutralization respectively. Also suitable are the esters of alpha-sulfo fatty acids (ester sulfonates) for example the alpha-sulfonated methyl esters of hydrogenated coconut, palm kernel or tallow fat acids, which are prepared by sulfonating the methyl esters of fatty acids of vegetable and/or animal origin having from 8 to 20 carbon atoms in the fatty acid molecule and subsequent neutralization to give water-soluble monosalts. Further suitable anionic surfactants are sulfonated fatty acid glycerol esters which are mono-, di- and triesters, and mixtures thereof. Preferred alk(en)yl sulfates are the alkali metal and in particular the sodium salts of the sulfuric monoesters of the $C_{12}$–$C_{18}$-fatty alcohols, for example of coconut fatty alcohol, tallow fatty alcohol, lauryl, myristyl, cetyl or stearyl alcohol, or of the $C_8$–$C_{20}$-oxo alcohols and those monoesters of secondary alcohols of this chain length. Also preferred are alk(en)yl sulfates of the chain length mentioned which contain a synthetic, straight-chain alkyl radical prepared on a petrochemical basis. 2,3-Alkyl sulfates are also suitable anionic surfactants. Also suitable are the sulfuric monoesters of the straight-chain or branched alcohols ethoxylated with from 1 to 6 mol of ethylene oxide, such as 2-methyl-branched $C_9$–$C_{11}$-alcohols with on average 3.5 mol of ethylene oxide (EO) or $C_{12}$–$C_{18}$ fatty alcohols having from 1 to 4 EO.

The preferred anionic surfactants also include the salts of alkylsulfosuccinic acid which are also referred to as sulfosuccinates or as sulfosuccinic esters, and the mono- and/or diesters of sulfosuccinic acid with alcohols, preferably with fatty alcohols and in particular with ethoxylated fatty alcohols. Preferred sulfosuccinates contain $C_8$–$C_{18}$ fatty alcohol radicals or mixtures of these. Useful further anionic surfactants include fatty acid derivatives of amino acids, for example of N-methyltaurine (taurides) and/or of N-methylglycine (sarcosinates). Useful further anionic surfactants include in particular soaps, for example in amounts of from 0.2 to 5% by weight. Especially suitable are saturated fatty acid soaps, such as the salts of lauric acid, myristic acid, palmitic acid, stearic acid, hydrogenated erucic acid and behenic acid, and also in particular soap mixtures derived from natural fatty acids, for example coconut, palm kernel or tallow fat acids.

The anionic surfactants, including the soaps, may be present in the form of their sodium, potassium or ammonium salts, and as soluble salts of organic bases, such as mono-, di- or triethanolamine. The anionic surfactants are preferably present in the form of their sodium or potassium salts, in particular in the form of the sodium salts. Anionic surfactants are present in inventive laundry detergents preferably in amounts of from 0.5 to 10% by weight and in particular in amounts of from 5 to 25% by weight.

The nonionic surfactants used are preferably alkoxylated, advantageously ethoxylated, in particular primary alcohols having preferably 8 to 18 carbon atoms and on average from 1 to 12 mol of ethylene oxide (EO) per mole of alcohol, in which the alcohol radical may be linear or preferably 2-methyl-branched, or may contain linear and methyl-branched radicals in a mixture, as are typically present in oxoalcohol radicals. However, especially preferred are alcohol ethoxylates having linear radicals from alcohols of native origin having from 12 to 18 carbon atoms, for example from coconut, palm, tallow fat or oleyl alcohol, and on average from 2 to 80 EO per mole of alcohol. Preferred ethoxylated alcohols include, for example, $C_{12}$–$C_{14}$-alcohols having 3 EO or 4 EO, $C_9$–$C_{11}$-alcohols having 7 EO, $C_{13}$–$C_{15}$-alcohols having 3 EO, 5 EO, 7 EO or 8 EO, $C_{12}$–$C_{18}$-alcohols having 3 EO, 5 EO or 7 EO and mixtures of these, such as mixtures of $C_{12}$–$C_{14}$-alcohol having 3 EO and $C_{12}$–$C_{18}$-alcohol having 7 EO. The degrees of ethoxylation specified constitute statistical averages which may be an integer or a fraction for a specific product. Preferred alcohol ethoxylates have a narrow homolog distribution (narrow range ethoxides, NRE). In addition to these nonionic surfactants, fatty alcohols having more than 12 EO may also be used. Examples thereof are (tallow) fatty alcohols having 14 EO, 16 EO, 20 EO, 25 EO, 30 EO or 40 EO.

The nonionic surfactants also include alkylglycosides of the general formula $RO(G)_x$ in which R is a primary, straight-chain or methyl-branched, in particular 2-methyl-branched, aliphatic radical having from 8 to 22, preferably from 12 to 18, carbon atoms, and G is a glycose unit having 5 or 6 carbon atoms, preferably glucose. The degree of oligomerization x which specifies the distribution of monoglycosides and oligoglycosides is an arbitrary number, which may also assume fractional values as a quantity to be determined analytically, between 1 and 10; x is preferably from 1.2 to 1.4. Likewise suitable are polyhydroxy fatty acid amides of the formula (I)

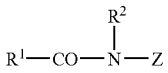

(I)

in which the $R^1CO$ radical is an aliphatic acyl radical having from 6 to 22 carbon atoms, $R^2$ is hydrogen, an alkyl or hydroxyalkyl radical having from 1 to 4 carbon atoms and [Z] is a linear or branched polyhydroxyalkyl radical having from 3 to 10 carbon atoms and from 3 to 10 hydroxyl groups. The polyhydroxy fatty acid amides preferably derive from reducing sugars having 5 or 6 carbon atoms, in particular from glucose.

The group of the polyhydroxy fatty acid amides also includes compounds of the formula (II)

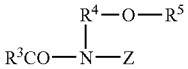

(II)

in which $R^3$ is a linear or branched alkyl or alkenyl radical having from 7 to 21 carbon atoms, $R^4$ is a linear, branched or cyclic alkylene radical or an arylene radical having from 6 to 8 carbon atoms and $R^5$ is a linear, branched or cyclic alkyl radical or an aryl radical, or an oxyalkyl radical having from 1 to 8 carbon atoms, preference being given to $C_1$–$C_4$-alkyl or phenyl radicals, and [Z] is a linear polyhydroxyalkyl radical whose alkyl chain is substituted by at least two hydroxyl groups, or alkoxylated, preferably ethoxylated or propoxylated, derivatives of this radical. [Z] is obtained here too preferably by reductive amination of a sugar such as glucose, fructose, maltose, lactose, galactose, mannose or xylose. The N-alkoxy or N-aryloxy-substituted compounds may then be converted to the desired polyhydroxy fatty acid amides, for example, by reacting with fatty acid methyl esters in the presence of an alkoxide as a catalyst.

A further class of nonionic surfactants used with preference, which may be used either as the sole nonionic surfactant or in combination with other nonionic surfactants, especially together with alkoxylated fatty alcohols and/or alkylglycosides, is that of alkoxylated, preferably ethoxylated or ethoxylated and propoxylated, fatty acid alkyl esters, preferably having from 1 to 4 carbon atoms in the alkyl chain, in particular fatty acid methyl esters.

Nonionic surfactants of the amine oxide type, for example N-cocoalkyl-N,N-dimethylamine oxide and N-tallow alkyl-N,N-dihydroxyethylamine oxide and of the fatty acid alkanolamides may also be suitable.

From the large group of the cationic surfactants, preference is given in particular to hydroxyalkyl quats of the general structures (III) and (IV).

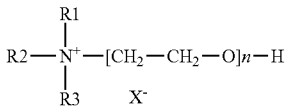

(III)

-continued (IV)

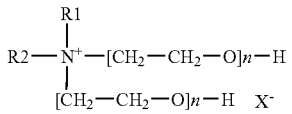

with the R1, R2, R3 radicals=$C_1$–$C_{22}$-alkyl, and n=from 1 to 5.

Useful further surfactants are what are known as gemini surfactants. This generally refers to those compounds which have two hydrophilic groups per molecule. These groups are generally separated from one another by a "spacer". This spacer is generally a carbon chain which should be long enough that the hydrophilic groups have a sufficient separation and they can act independently of one another. Such surfactants generally feature an unusually low critical micelle concentration and the ability to greatly reduce the surface tension of water. However, it is also possible to use gemini polyhydroxy fatty acid amides or poly-polyhydroxy fatty acid amides. Further surfactant types may have dendrimeric structures.

An inventive laundry detergent preferably comprises at least one water-soluble and/or water-insoluble, organic and/or inorganic builder.

Useful water-soluble inorganic builder materials are in particular alkali metal silicates and polymeric alkali metal phosphates, which may be present in the form of their alkaline, neutral or acidic, sodium or potassium salts. Examples thereof are trisodium phosphate, tetrasodium diphosphate, disodium dihydrogendiphosphate, pentasodium triphosphate, what is known as sodium hexametaphosphate, and the corresponding potassium salts, or mixtures of sodium and potassium salts. The water-insoluble, water-dispersible inorganic builder materials used are in particular crystalline or amorphous alkali metal aluminosilicates, in amounts of up to 50% by weight. Among these, preference is given to the crystalline sodium aluminosilicates in detergent quality, in particular zeolite A, P and optionally X, alone or in mixtures, for example in the form of a cocrystal or zeolites A and X. Their calcium binding capacity which can be determined according to the specifications of the German patent DE 24 12 837 is generally in the range from 100 to 200 mg of CaO per gram. Suitable builder substances are also crystalline alkali metal silicates which may be used alone or in a mixture with amorphous silicates. The alkali metal silicates which can be used as builders preferably have a molar ratio of alkali metal oxide to $SiO_2$ below 0.95, in particular from 1:1.1 to 1:12, and may be present in amorphous or crystalline form. Preferred alkali metal silicates are the sodium silicates, in particular the amorphous sodium silicates having a molar $Na_2O$:SiO ratio of from 1:2 to 1:2.8. Such silicates may be prepared by the process of the European patent application EP 0 425 427. The crystalline silicates which may be present alone or in a mixture with amorphous silicates are preferably crystalline sheet silicates of the general formula $Na_2Si_xO_{2x+1}$ Y $H_2O$ in which x, known as the modulus, is from 1.9 to 4, and y is from 0 to 20, and preferred values of x are 2, 3 or 4. Crystalline sheet silicates which fall under this general formula are described, for example, in the European patent application EP 0 164 514. Preferred crystalline sheet silicates are those in which x in the general formula specified assumes the values of 2 or 3. Preference is given in particular to both α- and β-sodium disilicates ($Na_2Si_2O_5$ y $H_2O$), β-sodium disilicate being obtainable, for example, by the process which is described in WO 91/08171. β-Sodium silicates having a modulus between 1.9 and 3.2 may be prepared in accordance with the Japanese patent applications JP 04/238 809 or JP 04/260 610. It is also possible to use virtually anhydrous, crystalline alkali metal silicates, prepared from amorphous silicates, of the abovementioned general formula, in which x is a number from 1.9 to 2.1. In a further preferred embodiment of such compositions, a crystalline sodium sheet silicate having a modulus of from 2 to 3 is used. Crystalline sodium silicates having a modulus in the range from 1.9 to 3.5 are used in a further preferred embodiment. In a preferred embodiment, a granular compound of alkali metal silicate and alkali metal carbonate is used, as obtainable, for example, under the Nabion® name. If alkali metal aluminosilicate, in particular zeolite, is also present as an additional builder substance, the weight ratio of aluminosilicate to silicate, based in each case on anhydrous active substances, is preferably from 1:10 to 10:1. In compositions which comprise both amorphous and crystalline alkali metal silicates, the weight ratio of amorphous alkali metal silicate to crystalline alkali metal silicate is preferably from 1:2 to 2:1 and in particular from 1:1 to 2:1.

Such builder substances are present in inventive compositions preferably in amounts of up to 60% by weight, in particular from 5 to 40% by weight.

The water-soluble organic builder substances include polycarboxylic acids, especially citric acid and sugar acids, aminopolycarboxylic acids, especially methylglycinediacetic acid, nitrilotriacetic acid and ethylenediaminetetra-acetic acid, and also polyaspartic acid.

Polyphosphonic acids, especially aminotris(methylenephosphonic acid), ethylenediaminetetrakis(methylenephosphonic acid) and 1-hydroxyethane-1,1-diphosphonic acid may likewise be used. Preference is also given to polymeric (poly)carboxylic acids, especially the polycarboxylates, obtainable by oxidation of polysaccharides and dextrins, of the international patent application WO 93/161 10 and the international patent application WO 92/18542 or the European patent application EP 0 232 202 respectively, polymeric acrylic acids, methacrylic acids, maleic acids and copolymers of these which may also contain small fractions of polymerizable substances without carboxylic acid functionality in copolymerized form. The relative molecular mass of the homopolymers of unsaturated carboxylic acids is generally between 5000 and 200 000, that of the copolymers between 2000 and 200 000, preferably from 50 000 to 120 000, based in each case on free acid. A particularly preferred acrylic acid-maleic acid copolymer has a relative molecular mass of from 50 000 to 100 000. Commercial products are, for example, Sokalan® CP 5, CP 10 and PA 30 from BASF. Also suitable are copolymers of acrylic acid or methacrylic acid with vinyl ethers, such as vinyl methyl ethers, vinyl esters, ethylene, propylene and styrene, in which the proportion of the acid is at least 50% by weight. The water-soluble organic builder substances used may also be terpolymers which contain, as monomers, two unsaturated acids and/or salts thereof and, as a third monomer, vinyl alcohol and/or an esterified vinyl alcohol or a carbohydrate. The first acidic monomer or salt thereof derives from a monoethylenically unsaturated $C_3$–$C_8$ carboxylic acid and preferably from a $C_3$–$C_4$-monocarboxylic acid, especially from (meth)acrylic acid.

The second acidic monomer or the salt thereof may be a derivative of a $C_4$–$C_8$ dicarboxylic acid, particular preference being given to maleic acid, and/or a derivative of an allysulfonic acid which is substituted in the 2-position by an alkyl or aryl radical. Such polymers can be prepared in particular by processes which are described in the German patents DE 42 21 381 and DE 43 00 772, and generally have a relative molecular mass between 1000 and 200 000. Further preferred copolymers are those which are described in the German patent applications DE 43 03 320 and DE 44 17 734, and preferably have as monomers acrolein and acrylic acid/acrylic acid salts or vinyl acetate.

Especially for the preparation of liquid compositions, the organic builder substances may be used in the form of aqueous solutions, preferably in the form of from 30 to 50% by weight aqueous solutions. All of the acids mentioned are generally used in the form of their water-soluble salts, especially their alkali metal salts. Such organic builder substances may, if desired, be present in amounts of up to 40% by weight, in particular up to 25% by weight, and preferably from 1 to 8% by weight. Amounts close to the upper limit mentioned are used preferably in pasty or liquid, especially aqueous compositions.

Useful water-soluble builder components in inventive cleaning compositions for hard surfaces are in principle all builders used customarily in compositions for the machine cleaning of dishes, for example the abovementioned alkali metal phosphates. Their amounts may be in the range of up to about 60% by weight, in particular from 5 to 20% by weight, based on the overall composition. Further possible water-soluble builder components, in addition to polyphosphonates and phosphonate alkyl carboxylates, are, for example, organic polymers of native or synthetic origin of the above-detailed type of the polycarboxylates which function as cobuilders especially in hard water regions, and naturally occurring hydroxycarboxylic acids, for example mono-, dihydroxysuccinic acid, alpha-hydroxypropionic acid and gluconic acid. The organic builder components used with preference include the salts of citric acid, especially sodium citrate. The sodium citrate used is anhydrous trisodium citrate and preferably trisodium citrate dihydrate. Trisodium citrate dihydrate may be used in the form of finely or coarsely crystalline powder. Depending upon the pH set ultimately in the inventive cleaning compositions, the acids corresponding to the cobuilder salts mentioned may also be present.

The enzymes optionally present in the inventive compositions include proteases, amylases, pullulanases, cellulases, cutinases and/or lipases, for example proteases such as BLAP®, Optimase®, Opticlean®, Maxacal®, Maxapem®, Durazym®, Purafect® OxP, Esperase® and/or Savinase®, amylases such as Termamy®, Amylase-LT, Maxamyl®, Duramyl®, Purafectel OxAm, cellulases such as Celluzyme®, Carezyme®, K-AC® and/or the cellulases and/or lipases disclosed by the international patent applications WO 96/34108 and WO 96/34092, such as Lipolase®, Lipomax®, Lumafast® and/or Lipozym®. The enzymes used may, as described, for example, in the international patent applications WO 92/111347 or WO 94/23005, be adsorbed on carriers and/or embedded in coating substances in order to protect them from premature inactivation. They are present in inventive laundry detergents and cleaning compositions preferably in amounts of up to 10% by weight, in particular from 0.05 to 5% by weight, particular preference being given to the use of enzymes stabilized against oxidative degradation.

Inventive machine dishwasher detergents preferably comprise the customary alkali carriers, for example alkali metal silicates, alkali metal carbonates and/or alkali metal hydrogencarbonates. The customarily used alkali carriers include carbonates, hydrogencarbonates and alkali metal silicates having a molar $SiO_2/M_2O$ ratio (M=alkali metal atom) of from 1:1 to 2.5:1. Alkali metal silicates may be present in amounts of up to 40% by weight, in particular from 3 to 30% by weight, based on the overall composition. The alkali carrier system used with preference in the inventive cleaning compositions is a mixture of carbonate and hydrogencarbonate, preferably sodium carbonate and hydrogencarbonate which may be present in an amount of up to 50% by weight, preferably from 5 to 40% by weight.

The invention further provides a composition for the machine washing of dishes, containing from 15 to 65% by weight, in particular from 20 to 60% by weight, of water-soluble builder component, from 5 to 25% by weight, in particular from 8 to 17% by weight, of oxygen-based bleach, based in each case on the overall composition, and from 0.1 to 1% by weight of one or more of the above-defined metal complexes. Such a composition is preferably slightly alkaline, i.e. its solution has a pH of from 8 to 11.5, in particular from 9 to 11.

In a further embodiment of inventive compositions for the automatic washing of dishes, from 20 to 60% by weight of water-soluble organic builders, in particular alkali metal citrate, from 3 to 20% by weight of alkali metal carbonate and from 3 to 40% by weight of alkali metal disilicate are present.

In order to bring about silver corrosion protection, it is possible to use silver corrosion inhibitors in inventive cleaning compositions for dishes. Preferred silver corrosion protectants are organic sulfides such as cystine and cysteine, di- or trihydric phenols, optionally alkyl- or aryl-substituted triazoles such as benzotriazole, isocyanuric acid, salts and/or complexes of titanium, zirconium, hafnium, molybdenum, vanadium or cerium, and salts and/or complexes of the metals present in complexes suitable in accordance with the invention with ligands other than those specified in formula (I).

When the compositions foam too vigorously on use, it is possible also to add to them up to 6% by weight, preferably from about 0.5 to 4% by weight, of a foam-regulating compound, preferably from the group comprising silicones, paraffins, paraffin-alcohol combinations, hydrophobicized silicas, fatty acid bisamides and mixtures thereof, and other known commercially available foam inhibitors. The foam inhibitors, especially silicone- and/or paraffin-containing foam inhibitors, are preferably bound to a granular carrier substance soluble or dispersible in water. Special preference is given to mixtures of paraffins and bistearylethylenediamide. Further optional ingredients in the inventive compositions are, for example, perfume oils.

The organic solvents which can be used in the inventive compositions, especially when they are present in liquid or pasty form, include alcohols having from 1 to 4 carbon atoms, in particular methanol, ethanol, isopropanol and tert-butanol, diols having from 2 to 4 carbon atoms, especially ethylene glycol and propylene glycol, and mixtures thereof and the ethers derivable from the compound classes mentioned. Such water-miscible solvents are present in the inventive cleaning compositions preferably to an extent of not more than 20% by weight, in particular from 1 to 15% by weight.

To set a desired pH which does not arise automatically by the mixing of the remaining components, the inventive compositions may comprise system- and environment-compatible acids, especially citric acid, acetic acid, tartaric acid, malic acid, lactic acid, glycolic acid, succinic acid, glutaric acid and/or adipic acid, but also mineral acids, especially sulfuric acid or alkali metal hydrogensulfates, or bases, especially ammonium or alkali metal hydroxides. Such pH regulators are present in the inventive compositions preferably to the extent of not more than 10% by weight, in particular from 0.5 to 6% by weight.

The inventive compositions are in the form of pulverulent, granular or tableted preparations which can be produced in a known manner, for example by mixing, granulating, roll-compacting and/or by spray-drying the thermally stressable components, and mixing in the more sensitive components, which include in particular enzymes, bleaches and the bleach catalyst. Inventive compositions in the form of aqueous solutions or those comprising other customary solvents are particularly advantageously prepared by simply mixing the ingredients which can be introduced in substance or as a solution into an automatic mixer.

To produce particulate compositions with increased bulk density, especially in the range from 650 g/l to 950 g/l, preference is given to a process which has an extrusion step and is disclosed by the European patent EP 0 486 592. A further preferred production method with the aid of a granulation process is described in the European patent EP 0 642 576. Inventive compositions in the form of nondusting, storage-stably free-flowing powders and/or granules having high bulk densities in the range from 800 to 1000 g/l can also be prepared by mixing, in a first process stage, the builder components with at least a portion of liquid mixture components while increasing the bulk density of this premixture, and subsequently, if desired after an intermediate drying, combining the further constituents of the composition, including the bleach catalyst, with the thus obtained premixture.

To prepare the inventive compositions in tablet form, the procedure is preferably to mix all constituents with one another in a mixer and to compress the mixture by means of conventional tablet presses, for example eccentric presses or rotary presses, with compression pressures in the range from 200 $10^5$ Pa to 1500 $10^5$ Pa. In this way, tablets which are fracture-resistant and nevertheless sufficiently rapidly soluble under use conditions and have flexural strengths of normally above 150 N are obtained without any problem. A tablet prepared in this way preferably has a weight of from 1–5 g to 40 g, in particular from 20 g to 30 g, at a diameter of from 3–5 mm to 40 mm.

In liquid or pasty applications, the inventive complexes are used preferably in the form of an aqueous solution or in microencapsulated form. When they are used for the purposes of utilizing atmospheric oxygen (aerial bleaching), it is possible to dispense with the use of peroxo compounds. However, when they are to be used in combination with a peroxo compound, for example hydrogen peroxide, it is recommended to use a multichamber container.

EXAMPLES

Example 1

Synthesis of (1,8-diethyl-1,4,8,11-tetraazacyclotetradecane)manganese(II) chloride (cat 1)

12.6 g (0.1 mol) of manganese(II) chloride were dissolved in 100 ml of DMAC. The solution was admixed with 25.6 g (0.1 mol) of 1,8-diethyl-1,4,8,11-tetraazacyclotetradecane. The reaction mixture was heated to 100° C. for 5 hours. The resulting suspension was cooled to room temperature, and the resulting solid was filtered off, washed with 50 ml of DMAC and subsequently dried at 80° C. under reduced pressure. 37.1 g of the light gray complex were obtained, which corresponds to a yield of 97.0%.

Analytical data:

| Elemental analysis for $C_{14}H_{32}N_4Cl_2Mn$ (382.2 g/mol): | | | | |
|---|---|---|---|---|
| calculated: | C 43.9%, | H 8.4%, | N 14.6%, | Cl 18.6%, Mn 14.6% |
| found: | C 44.1%, | H 8.8%, | N 14.6%, | Cl 18.7%, Mn 13.7% |

Example 2

Synthesis of (1,8-diethyl-1,4,8,11-tetraazacyclotetradecane)iron(II) chloride (cat 2)

12.7 g (0.1 mol) of iron(II) chloride were initially charged in 100 ml of DMAC and subsequently admixed with 25.6 g (0.1 mol) of 1,8-diethyl-1,4,8,11-tetraazacyclotetradecane. The reaction mixture was heated to 100° C. for 5 hours. The resulting suspension was cooled to room temperature, and the solid formed was filtered off, washed with 50 ml of DMAC and subsequently dried at 80° C. under reduced pressure. 34.9 g of the beige-light brown complex were obtained, which corresponds to a yield of 91.0%.

Analytical data:

| Elemental analysis for $C_{14}H_{32}N_4Cl_2Fe$ (383.1 g/mol): | | | | |
|---|---|---|---|---|
| calculated: | C 43.8%, | H 8.4%, | N 14.6%, | Cl 18.5%, Fe 14.7% |
| found: | C 43.9%, | H 8.8%, | N 14.5%, | Cl 18.6%, Fe 14.4% |

Example 3

Synthesis of (1,4,8,11-tetraazacyclotetradecane)manganese(II) chloride (cat 3)

Under nitrogen, 9.0 g (0.072 mol) of manganese(II) chloride were dissolved in 100 ml of DMAC. The solution was admixed with 14.4 g (0.072 mol) of 1,4,8,11-tetraazacyclotetradecane. The reaction mixture was heated to 100° C. for 5 hours, then cooled to room temperature. The precipitate formed was filtered off, washed with 50 ml of DMAC and subsequently dried at 80° C. under reduced pressure. 22.9 g of the light gray complex were obtained, which corresponds to a yield of 97.5%.

Analytical data:

| Elemental analysis for $C_{10}H_{24}N_4MnCl_2$ (326.0 g/mol): | | | | |
|---|---|---|---|---|
| calculated: | C 36.8%, | H 7.4%, | N 17.2%, | Cl 21.8%, Mn 16.8% |
| found: | C 37.1%, | H 7.4%, | N 16.5%, | Cl 20.7%, Mn 16.1% |

Example 4

Synthesis of (1,8-dimethyl-1,4,8,11-tetraazacyclotetradecane)manganese(II) chloride tetraphenylborate (cat 4)

Under nitrogen, 2.5 g (0.02 mol) of manganese(II) chloride were dissolved in 100 ml of methanol. The solution was admixed with 4.5 g (0.02 mol) of 1,8-dimethyl-1,4,8,11-tetraazacyclotetradecane. The reaction mixture was stirred at room temperature for 2 hours and then admixed with 16.4 g (0.048 mol) of sodium tetraphenylborate. After the reaction had been stirred at room temperature for a further 30 min, the precipitate formed was filtered off, washed repeatedly with methanol and dried. 11.3 g of the light gray complex were obtained, which corresponds to a yield of 88.6%.

Example 5

Synthesis of (1,8-diethyl-1,4,8,11-tetraazacyclotetradecane)manganese(II) chloride tetraphenylborate (cat 5)

Under nitrogen, 2.5 g (0.02 mol) of manganese(II) chloride were dissolved in 100 ml of methanol. The solution was admixed with 5.1 g (0.02 mol) of 1,8-diethyl-1,4,8,11-tetraazacyclotetradecane. The reaction mixture was stirred at room temperature for 2 hours and then admixed with 16.4 g (0.048 mol) of sodium tetraphenylborate. After the reaction had been stirred at room temperature for a further 30 min, the precipitate formed was filtered off, washed repeatedly with methanol and dried. 6.4 g of the light beige complex were obtained, which corresponds to a yield of 48.0%.

Example 6

Bleaching performance of cat 1, cat 2 and cat 3 in the presence of peroxides. The bleaching performance of the inventive compounds cat 1 and cat 2 was tested in comparison to the bleach activator TAED. To this end, 10 mg/l of cat 1, cat 2 or cat 3 were dissolved in a wash liquor prepared by dissolving 2 g/l of a bleach-free base detergent (WMP, WFK, Krefeld). After 1 g/l of sodium percarbonate (Degussa) had been added, the wash experiments were carried out at 40° C. in a Linitest apparatus (from Heräus). The wash time was 30 min, water hardness 18° GH. The bleach test fabric used was 2 tea stains on cotton (BC-1 and BC3, WFK, Krefeld). The bleaching result was rated by the difference in reflectance measured with an Elrepho instrument after the wash in comparison to the unwashed fabric. The comparative experiment (C1) used 250 mg/l of TAED instead of the inventive 10 mg/l of the compounds (cat 1 to cat 3).

| Difference in reflectance (ddR %) | | |
|---|---|---|
| Compound | BC1 | BC3 |
| Cat 1 | 7.1 | 10.6 |
| Cat 2 | 1.6 | 2.0 |
| Cat 3 | 7.2 | 8.1 |
| TAED (C1) | 3.1 | 3.2 |

It can be seen that the inventive compounds (cat 1 to cat 3) can achieve a significant bleaching action. Especially cat 1 also exhibits distinct advantages over the conventional bleach activator TAED, which was used in substantially higher concentration (C1).

Substantially the same results were obtained when the sodium percarbonate was replaced by sodium perborate.

Example 7

Bleaching Performance in Combination with an Activator

The bleaching performance of the inventive compound C1 was tested in combination with the bleach activator TAED. To this end, 10 mg/l of cat 1 and 200 mg/l of TAED were dissolved in a wash liquor prepared by dissolving 2 g/l of a bleach-free base detergent (WMP, WFK, Krefeld). After 1 g/l of sodium percarbonate (Degussa) had been added, the wash experiments were carried out at 40° C. in a Linitest apparatus (from Heräus). The wash time was 30 min, water hardness 18° GH. The bleach test fabric used was 2 tea stains on cotton (BC-1 and BC3, WFK, Krefeld). The bleaching result was rated by the difference in reflectance measured with an Elrepho instrument after the wash in comparison to the unwashed fabric. The comparative experiment (C2) used 250 mg/l of TAED:

| Difference in reflectance (ddR %) | | |
|---|---|---|
| Compound | BC1 | BC3 |
| Cat 1 + TAED | 8.8 | 10.2 |
| TAED (C2) | 3.0 | 3.1 |

It can be seen that the inventive compound cat 1 can achieve a significant bleaching action. Substantially the same results were obtained when the sodium percarbonate was replaced by sodium perborate.

Example 8

Bleaching in the Presence of Atmospheric Oxygen

The bleaching performance of the inventive compounds cat 1 and cat 2 was tested without having peroxides. To this end, 10 mg/l of cat 1 or cat 2 were dissolved in a wash liquor prepared by dissolving 2 g/l of a bleach-free base detergent (WMP, WFK, Krefeld). The wash experiments were carried out in a Linitest instrument (from Heräus) at 20 and 40° C. The wash time was 30 min, water hardness 18° GH. After the wash, the fabric was dried and ironed. The bleach test fabric used was two self-prepared oily stains on cotton (ketchup/oil and curry/oil, prepared by boiling ketchup or curry powder with sunflower oil). The bleaching result was rated by the difference in reflectance, measured with an Elrepho instrument, after the wash in comparison to the unwashed fabric. The comparative experiment (C1) used the detergent without complex addition.

Results of the wash at 20° C.

| Difference in reflectance (dR %) | | |
|---|---|---|
| Compound | Ketchup/oil | Curry/oil |
| Cat 1 | 66.5 | 38.1 |
| Cat 2 | 59.9 | 36.2 |
| Cat 3 | 48.4 | 30.8 |
| WMP | 43.9 | 25.9 |

Results of the wash at 40° C.

| Compound | Difference in reflectance (dR %) Ketchup/oil | Curry/oil |
|---|---|---|
| Cat 1 | 75.6 | 57.8 |
| Cat 2 | 67.0 | 54.2 |
| WMP | 42.8 | 35.2 |

It can be seen that the inventive compounds, especially cat 1 and cat 2, develop a significant bleaching action.

Example 9

Bleaching Performance of Cat 4 and Cat 5 in the Presence of Peroxides

The experiments were carried analogously to example 6. The wash temperatures selected were 20 and 40° C.

| Compound | Difference in reflectance (ddR %) 20° C. BC1 | BC3 | 40° C. BC1 | BC3 |
|---|---|---|---|---|
| Cat 4 | 0.7 | 0.4 | 1.5 | 3.2 |
| Cat 5 | 1.4 | 1.3 | 5.9 | 9.0 |
| TAED (C1) | 1.3 | 1.3 | 3.0 | 3.1 |
| Example 10 | | | | |

Example 10

Bleaching Performance of the Catalysts Cat 4 and Cat 5 in the Presence of Atmospheric Oxygen The experiments were carried out analogously to example 8 at 20° C. on curry/oil stain.

Results

| Compound | Difference in reflectance (dR %) Curry/oil |
|---|---|
| Cat 4 | 24.9 |
| Cat 5 | 30.5 |
| WMP | 21.0 |

What is claimed is:

1. A method for catalyzing a bleaching compound in a laundry detergent or a cleaning composition containing a surfactant, said method comprising adding to the bleach compound, a bleach catalyst comprising a transition metal complex of formula (I)

$$[M(L)Y_n]X_m \quad (I)$$

where

M is a manganese metal atom;

L is a ligand of the general formula (IV), (IV)

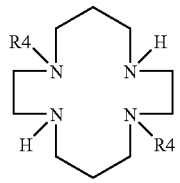

where R4 is ethyl,

X and Y are each an uncharged or an anionic ligand selected from the group consisting of $CH_3CN$, chloride, bromide, nitrate, perchlorate, sulfate, citrate, hexafluorophosphate, trifluoromethanesulfonate, tetrafluoroborate, tetraphenylborate, an anion of organic acids having $C_1$–$C_{22}$ carbon atoms, and mixtures thereof, n and m are each a number from 0 to 4, wherein said laundry detergent or cleaning composition contains from 0.0025% by weight to 1% by weight of the transition metal complex.

2. The method of claim 1, wherein the bleach compound comprises a peroxygen compound or atmospheric oxygen.

3. A method for bleaching colored stains on hard surfaces or on textiles, said method comprising contacting said colored stains with an aqueous solution of a laundry detergent or a cleaning composition comprising a bleach compound, a surfactant and a transition metal complex of formula (I)

$$[M(L)Y_n]X_m \quad (I)$$

where

M is a manganese metal atom,

L is a ligand of the general formula (IV), (IV)

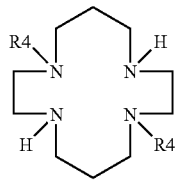

where R4 is ethyl,

X and Y are each an uncharged or an anionic ligand selected from the group consisting of $CH_3CN$, chloride, bromide, nitrate, perchlorate, sulfate, citrate, hexafluorophosphate, trifluoromethanesulfonate, tetrafluoroborate, tetraphenylborate, an anion of organic acids having $C_1$–$C_{22}$ carbon atoms, and mixtures thereof, n and m are each a number from 0 to 4, wherein said laundry detergent or cleaning composition contains from 0.0025% by weight to 1% by weight of the transition metal complex.

* * * * *